United States Patent [19]

Urlaub et al.

[11] 4,200,237

[45] Apr. 29, 1980

[54] FUEL INJECTOR

[75] Inventors: Alfred Urlaub, Nuremberg; Eckart Muller, Schwabach, both of Fed. Rep. of Germany

[73] Assignee: Maschinenfabrik Augsburg-Nurnberg Aktiengesellschaft, Nuremberg, Fed. Rep. of Germany

[21] Appl. No.: 910,740

[22] Filed: May 30, 1978

[30] Foreign Application Priority Data

Jun. 10, 1977 [DE] Fed. Rep. of Germany ..... 2726074

[51] Int. Cl.[2] ..... B05B 1/30

[52] U.S. Cl. ..... 239/533.12; 239/563

[58] Field of Search ..... 239/533.3, 533.12, 562, 239/563

[56] References Cited

U.S. PATENT DOCUMENTS

| | | | |
|---|---|---|---|
| 1,833,080 | 11/1931 | Kenworthy | 239/533.4 X |
| 2,625,435 | 1/1953 | Larborn | 239/533.4 |
| 3,442,451 | 5/1969 | DeNagel | 239/533.5 X |
| 3,612,407 | 10/1971 | Itano et al. | 239/533.12 X |

FOREIGN PATENT DOCUMENTS

| | | | |
|---|---|---|---|
| 767886 | 2/1954 | Fed. Rep. of Germany | 239/533.3 |

*Primary Examiner*—John J. Love

*Attorney, Agent, or Firm*—Buell, Blenko & Ziesenheim

[57] ABSTRACT

A fuel injector for internal combustion engines having an axially slidable nozzle needle capable of being lifted off its sealing seat by pressure of fuel against at least one spring and having a control pintle below the sealing seat sliding in a blind-hole recess is provided with the improvement comprising a cavity starting immediately below the sealing seat and formed as an eccentric widening extending parallel to the blind-hole type recess, said spray holes opening into said blind-hole type recess and the cross sectional areas of the nozzle seat gap and the cavity at each position of the needle nozzle are greater than the cross sectional area of the at least one spray hole uncovered at any time by the movement of the control pintle.

6 Claims, 6 Drawing Figures

Figure 3:
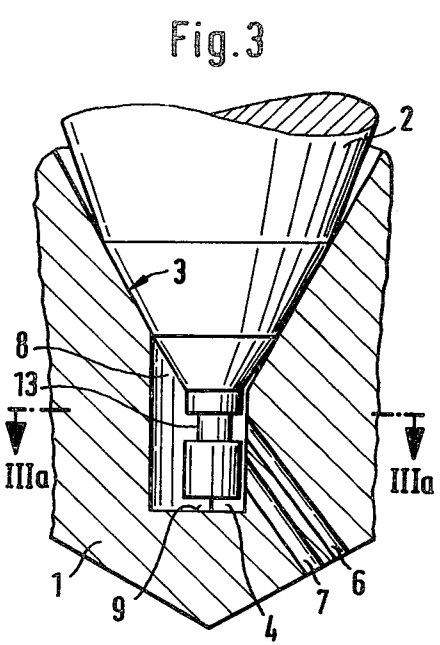

2
3
8
13
IIIa
IIIa
6
7
4
9
1

2
3
11
12
IIa
IIa
5
4
6
10
9
1

2
3
8
5
Ia
Ia
6
7
10
4
9
1

1
8
5
4
7
6

1
5
12
6
4

1
8
5
4
6

FUEL INJECTOR

This invention relates to a fuel injector for air-compressing internal combustion engines in which an axially slideable nozzle needle is provided which is capable of being lifted off its sealing seat by the pressure of the fuel against the force of one or a plurality of springs, the nozzle needle being formed below its sealing seat with a control pintle sliding in a blind-hole type recess in the injector body and covering one or a plurality of spray-holes wholly or substantially when the nozzle needle is in the closed position.

An injector of this type was disclosed by the Austrian Pat. Specification 217 250. In that injector there is at least one spray hole opening directly into the sealing seat of the nozzle needle or immediately below it into the nozzle body, whereas at least one second spray hole terminates below the control pintle in the blind-hole type recess. As soon as the nozzle needle is slightly opened, fuel will pass from the pressure space through the first spray hole or the first spray holes into the combustion chamber. Only when the nozzle needle is fully opened will the control pintle also uncover the remaining spray holes so that maximum fuel injection can occur.

As is well known, the quality of fuel injection is greatly dependant on the prevailing injection pressure. If, in the case of the afore-described injector, the nozzle needle is lifted only a little, the fuel pressure will be severely reduced by the narrow gap in the sealing seat. Especially during the opening and closing phases of the nozzle needle, this will result in only a substantially reduced pressure being available for injection at the spray holes. The consequence will be poor mixture formation and combustion resulting in a poor exhaust gas quality and increased fuel consumption. This applies in particular to the lower speed and load ranges of an engine where the greater portion or even the complete injection process will take place during the opening and closing phases of the nozzle needle.

In the upper speed and load ranges, the fuel pressure will increase and cause the nozzle needle to open fully. As a result, the gap in the sealing seat will be enlarged and the pressure losses upstream of the upper spray holes will be smaller. Simultaneously, the control pintle will be lifted a little out of the blind-hole type recess and uncover also the lower spray hole or spray holes but again the gap forming between the control pintle and the recess will cause a pressure reduction so that a lower injection pressure is liable to exist at the lower spray holes. In other words, the injector referred to is also subject to substantial throttling of the fuel upstream of the spray holes during the opening and closing phases.

This is already where the invention starts which has for its object to improve a fuel injector of the type initially described in a manner that the fuel pressure is available practically undiminished at the spray holes uncovered at each stage throughout the complete injection process.

According to the invention, this object is achieved in that the blind-hole type recess communicates with a cavity starting immediately below the sealing seat, in that all spray holes open into the blind-hole type recess and in that the cross-sectional areas of the nozzle seat gap and the cavity in each or nearly each position of the nozzle needle are greater than the cross-sectional area of the spray hole or spray holes uncovered at each particular time by the control pintle.

These features ensure that, at a small opening lift of the nozzle needle, the blind-hole type recess in which all spray holes eventually open, discharges such a small amount of fuel that the full injection pressure can build up in said recess. Since only a very small throttling action takes place in the sealing seat gap and in the cavity at all times, the full injection pressure will be available throughout the complete injection process at the spray holes whereby good mixture formation and combustion are ensured at all operating points of the engine.

As a further development of the invention, it is proposed that the cavity is formed as an eccentric widening extending parallel to the blind-hole type recess. Alternatively, it may consist of a transverse hole provided below the sealing seat in the nozzle needle and a longitudinal hole communicating with the transverse hole and extending through the complete control pintle. Naturally, it is also possible to have a combination of these two features.

In accordance with the invention, the spray holes may be open into the blind-hole type recess in a manner that only some of the spray holes may be capable of being uncovered or closed by the control pintle whereas the others open into the bottom of the recess and can be closed off only when the nozzle needle is fully closed.

As yet another development of the invention it is furthermore proposed that the control pintle is formed with an annular groove and that at least one spray hole is arranged so that, with the nozzle needle slightly opened, it opens into the recess at the level of the annular groove. The height of the annular groove and the remaining control pintle are preferably selected so that the spray hole or spray holes uncovered with the nozzle needle slightly opened are closed with the nozzle needle fully opened and, instead, one or a plurality of other spray holes are uncovered.

Incidentally, it may be mentioned that where necessary to match specific engines or their injection systems, the spray holes may obviously be disposed in parallel or in different directions and that their cross-sectional areas may be of different sizes and different shapes.

Figure 2:
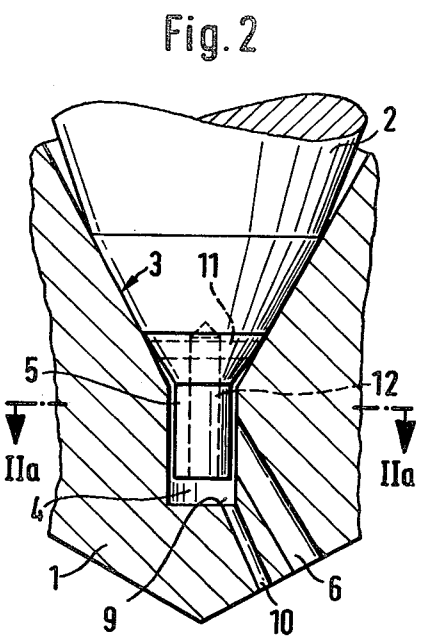
Figure 1:
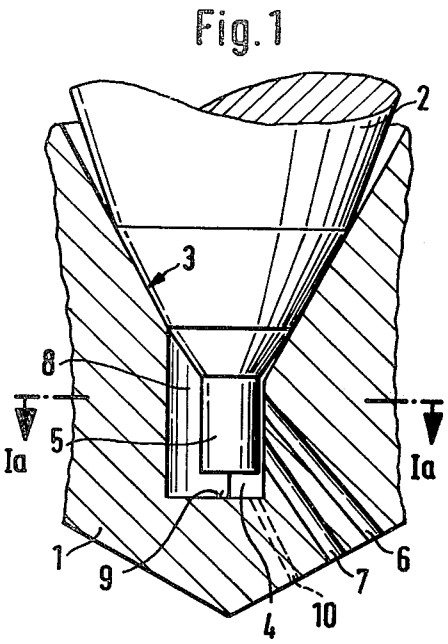

For further details of the invention, reference is made to the description below of a number of typical embodiments illustrated in the drawings in which FIGS. 1 to 3 are each a longitudinal section through the lower part of an injector with the arrangement according to the invention and spray holes of different configurations, FIGS. 1*a* to 3*a* are each a section I*a*–I*a* to III*a*–III*a* through FIGS. 1 to 3.

FIG. 1 shows a nozzle body 1 in which is arranged a nozzle needle 2 which contacts a conical sealing seat 3. At the lower end of the nozzle needle 2 there is a control pintle 5 sliding in a blind-hole type recess 4 which in this case is of semi-circular shape, with the pintle in the position illustrated covering two spray holes 6, 7 of different diameters. In parallel with the recess 4 and closely associated with this there is an eccentric widening 8 which starts immediately at the lower end of the sealing seat 3 and has a cross-sectional area which is greater than the total cross sectional area of all spray holes 6, 7. Furthermore, there is another typical embodiment shown by dotted lines where a spray hole 10 opens in the bottom 9 of the recess 4. Such a spray hole 10 will naturally not be influenced by the control pintle 5.

Figure 1A:
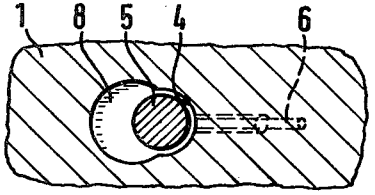

The shape of the recess 4 and the eccentric widening 8 as well as their connection can be seen in greater detail in FIG. 1*a*.

The subsequent Figures have the same parts provided with the same reference numerals as in FIGS. 1 and 1*a* so that only the respective deviations have to be explained.

Figure 2A:
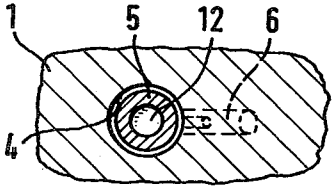

According to FIGS. 2 and 2*a*, the blind-hole type recess 4 is of circular cross-section and fully surrounds the control pintle 5. Immediately below the lower end of the sealing seat 3, there is a transverse hole 11 in the control pintle 5 and, respectively, also in the nozzle needle 2, which communicates with a longitudinal hole 12 which extends through the control pintle 5. In this configuration, the fuel is admitted through the holes 11 and 12 into the recess 4 and it should be mentioned that it is also possible to adopt a combination with the configuration according to FIG. 1.

Figure 3A:
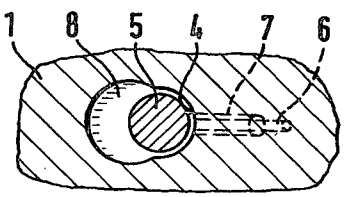

FIGS. 3 and 3*a* essentially correspond to FIGS. 1 and 1*a*, except that the control pintle is formed with an annular groove 13. The spray hole 6, which in this case is smaller, is arranged so that it communicates with the annular groove 13 when the nozzle needle 2 is slightly opened. When the nozzle needle 2 is further or fully opened, the spray hole 6 will be closed and the spray hole 7 opened. This configuration lends itself particularly well for engines where especially for cold starting or in the lower load range the fuel is to be injected into a different part of the combustion chamber than at full load.

We claim:

1. A fuel injector for internal combustion engines in which an axially slidable nozzle needle is provided which is capable of being lifted off its sealing seat to expose a gap therein by the pressure of the fuel against the force of at least one spring, said nozzle needle being formed with a control pintle below its sealing seat which slides in a blind-hole type recess in the nozzle body and at least substantially covers at least one spray hole when the nozzle needle is closed, the improvement comprising a cavity starting immediately below the sealing seat and formed as an eccentric widening extending parallel to the blind-hole type recess, said spray holes opening into said blind-hole type recess and the cross sectional areas of the nozzle seat gap and the cavity at each position of the needle nozzle are greater than the cross sectional area of the at least one spray hole uncovered at any time by the movement of the control pintle.

2. A fuel injector as in claim 1, characterized in that the cavity consists of a transverse hole (11) provided below the sealing seat (3) in the nozzle needle (2) and, communicating with the transverse hole, a longitudinal hole (12) extending through the whole control pintle (5).

3. A fuel injector as in claim 1 having at least two spray holes, characterized in that one or part of the spray holes (6, 7) open into the recess (4) in a manner that they are capable of being uncovered or closed by the control pintle (5) and in that an additional or a further part of the spray holes (10) open into the bottom (9) of the blind-hole type recess (4).

4. A fuel injector as in claim 1 having at least two spray holes, characterized in that all spray holes (6, 7) open into the recess in a manner that they are capable of being uncovered or closed simultaneously or in sequence by the control pintle (5).

5. A fuel injector as in claim 1, characterized in that the control pintle (5) is formed with an annular groove (13) and in that at least one spray hole (6) is arranged in a manner that it opens into the recess (4) at the level of the annular groove (13) when the nozzle needle (2) is slightly opened.

6. A fuel injector as in claims 1 or 5, characterized in that the height of the annular groove (13) and the control pintle (5) are selected in a manner that the spray hole or spray holes (6) uncovered with the nozzle needle (2) slightly opened are closed when the nozzle needle (2) is fully opened and, instead, one or a plurality of other spray holes (7) are uncovered.

* * * * *